US005793337A

United States Patent [19]

Schenkyr et al.

[11] Patent Number: 5,793,337

[45] Date of Patent: Aug. 11, 1998

[54] ANTENNAS DISPOSED ON SEPARATE GROUND PLANES

[75] Inventors: Dieter Schenkyr, Lenningen; Thomas Vogel, Aalen, both of Germany

[73] Assignee: Richard Hirschmann GmbH & Company, Neckartenzlingen, Germany

[21] Appl. No.: 588,916

[22] Filed: Jan. 19, 1996

[30] Foreign Application Priority Data

Jul. 21, 1993 [DE] Germany ..... 43 24 480.7

[51] Int. Cl.[6] ..... H01Q 1/48

[52] U.S. Cl. ..... 343/846; 343/713; 343/727

[58] Field of Search ..... 343/727, 713, 343/789, 840, 841, 829, 830, 846, 700.05, 853, 797

[56] References Cited

U.S. PATENT DOCUMENTS

| | | | |
|---|---|---|---|
| 2,141,489 | 12/1938 | Roseby . | |
| 3,039,096 | 6/1962 | Josephson . | |
| 3,739,392 | 6/1973 | Ross et al. | 343/840 |
| 4,675,685 | 6/1987 | Finken | 343/789 X |
| 4,719,470 | 1/1988 | Munson . | |
| 4,814,777 | 3/1989 | Monser | 343/727 |
| 4,912,482 | 3/1990 | Woloszczuk | 343/841 |
| 5,204,979 | 4/1993 | Schenkry et al. . | |
| 5,210,773 | 5/1993 | Schmid et al. . | |
| 5,457,467 | 10/1995 | Schenkyr et al. . | |

FOREIGN PATENT DOCUMENTS

| | | |
|---|---|---|
| 0 326 651 | 8/1989 | European Pat. Off. . |
| 0 500 380 | 8/1992 | European Pat. Off. . |
| 41 21 333 | 1/1993 | Germany . |
| 91/05374 | 4/1991 | WIPO . |
| 91/11830 | 8/1991 | WIPO . |

OTHER PUBLICATIONS

Conference Proceedings Military Microwaves 88, Jul. 1988, London, England, pp. 299–307, "High Power Stripline Corporate Feed Networks".

1979 International Symposium Digest Antennas and Propagation, vol. II, Jun. 1979, Seattle, Washington, pp. 600–683, Fukuzawa et al "The Characteristics of a Modified Duoconical Monopole with Curved Surface Transition".

*Primary Examiner*—Donald T. Hajec
*Assistant Examiner*—Tho Phan
*Attorney, Agent, or Firm*—Cushman Darby & Cushman IP Group of Pillsbury Madison & Sutro LLP

[57] ABSTRACT

In an aerial arrangement with a monopole aerial having a radiator and a counterweight, in which the radiator and the counterweight are each connected at opposite feed points to one conductor of a lead, a largely circular azimuthal pattern is obtained while avoiding the irradiation of the vehicle passenger compartment by using at least two parallel-connected monopole aerials interconnected via a line transformer.

15 Claims, 2 Drawing Sheets

ANTENNAS DISPOSED ON SEPARATE GROUND PLANES

FIELD OF THE INVENTION

The invention relates to an antenna arrangement including a monopole antenna which comprises an antenna radiator and an electrical counterpoise, wherein the radiator and the counterpoise are connected, at mutually opposite feedpoints, to a respective conductor of a feed line.

DESCRIPTION OF RELATED ART

Such kinds of antenna arrangements are known, for example, from DE 42 20 659 A1. Antenna arrangements of this type are provided for mounting on one of the windows of a motor vehicle. Amongst other things, such kinds of antenna arrangements have the disadvantage that they radiate into the passenger compartment of the motor vehicle, or that they radiate therethrough, in order to develop an approximately circular azimuthal radiation pattern. This results in an appreciable increase in the electromagnetic field strength within the vehicle. When, for example, an antenna arrangement of this kind is located on the rear windows, then electrical field strength of more than 100 V/m have been measured in the rear zone of the passenger compartment of the motor vehicle. However, in accordance with the recommendations of the VDE, 40 V/m should not be exceeded.

A combination antenna is known from the WO-A-91 11 830 in which two individual antenna sondes are simultaneously coupled to the same resonant circuit that is formed on an electrically conducting structure, for example, the boot lid of a vehicle. The two individual antennae are connected to one another via a lambda/half-rerouting line and form a single antenna arrangement. Here, the antenna sondes are not individual monopole antennae but rather, they are components of a single antenna. The electrical counterpoise of the two antenna sondes is simultaneously the counterpoise for the two of them.

A feed network having connecting leads of different widths which serve for the transformation of complex impedances, is known from the Conference Proceedings Military Microwaves 88, July 1988, London, England, P 299–307, Davies "High Power Stripline Corporate Feed Networks". The feed network and the connections have to be disposed with respect to a continuous, electrically conducting layer or arrangement which is integral to the whole network in order for the feed network to be capable of functioning.

SUMMARY OF THE INVENTION

Consequently, the object of the invention is to develop an antenna arrangement of the type mentioned hereinabove, which arrangement exhibits an approximately circular azimuthal radiation pattern without thereby radiating through the passenger compartment.

In accordance with the invention, this object is achieved in that, there are provided at least two parallel connected monopole antennae wherein a line transformer is arranged on the respective counterpoise of at least one monopole antenna.

Preferred developments of the invention form the subject matter of the appendant claims.

Through the use of the antenna arrangement in accordance with the invention, one is able to achieve the effect that a largely circular azimuthal polar diagram can be generated even when the antennae are installed below the window level of the passenger compartment. Due to the provision of a plurality of parallel connected monopole antennae, it is made possible for the antennae to generate a largely circular azimuthal polar diagram even when they are installed in the lower peripheral regions of the chassis despite the fact that the antennae are disposed in front of metallic parts of the chassis which reflect the electromagnetic radiation of the antenna. The passenger compartment is thus screened in this manner from the antenna radiation by virtue of the metallic parts of the chassis of the motor vehicle. The line transformer is implemented in a particularly space-saving and robust manner.

Preferably, the antenna arrangement in accordance with the invention comprises a line transformer which is constructed in the form of a strip line. The line transformer fulfills the task of matching the characteristic impedance which has been altered by the parallel connection of a plurality of monopole antennae to the characteristic impedance of the feed line. Thereby, the feed cable and the connecting lead or leads between the monopole antennae are preferably constructed in the form of a coaxial cable. The construction of the line transformer using strip line techniques thereby makes it possible to have a simple, space-saving type of transformation means, which is economical to manufacture and is very robust.

In accordance with another preferred embodiment of the antenna arrangement in accordance with the invention, the line transformer is arranged on the electrical counterpoise of an antenna. This has the advantage that the line transformer is constructed in a particularly robust and space-saving manner.

In accordance with a further preferred embodiment of the antenna arrangement in accordance with the invention, the radiator takes the form of an equilateral triangle. This has the advantage that the radiator has a frequency range which is greater by a factor of 1.5 to 2 vis a vis a rectangularly constructed radiator as is known from the state of the art.

In accordance with a further preferred embodiment of the antenna arrangement in accordance with the invention, the corners of the radiator and of the counterpoise are rounded. A shaping of the radiator and of the counterpoise of this kind likewise has the effect of producing a broadening of the frequency range of a monopole antenna.

In accordance with a further preferred embodiment of the antenna arrangement in accordance with the invention, the antennae are accommodated in at least one of the bumpers made of synthetic material of a motor vehicle. On the one hand thereby, one achieves the result that the antennae can be mounted at a defined distance from the bodywork and, on the other hand, the result is thereby achieved that the antennae can be installed in position and tested before the final manufacture of the motor vehicle.

In accordance with a further preferred embodiment of the antenna arrangement in accordance with the invention, the antennae are disposed on opposite sides of the motor vehicle. Due to this measure, a largely circular azimuthal polar diagram is achieved independently of the individual structural shapes of the chassis of the motor vehicle.

In accordance with a further preferred embodiment of the antenna arrangement in accordance with the invention, the radiators have a length of substantially Lambda/4 in the operational frequency range. One thereby achieves the result that the lengths of the radiators are optimally matched to the operational frequency range.

Thereby, the operational frequency range substantially corresponds to the frequency range that is associated with the electromagnetic decimetre-waveband.

In accordance with a further preferred embodiment of the antenna arrangement in accordance with the invention, the antennae are located at a distance from the chassis of the motor vehicle which corresponds to Lambda/4 of the operational frequency range. One thereby achieves the result that the metallic parts of the chassis of the motor vehicle located behind an antenna function as reflectors for the electromagnetic waves radiated by the antenna. The performance of the individual antennae is optimised in this manner.

In accordance with a further preferred embodiment of the antenna arrangement in accordance with the invention, the individual antennae are constructed as metal foils which are welded into films of synthetic material. This has the advantage that the antennae can be manufactured in a particularly economical and, at the same time, robust manner.

In correspondence with one advantageous embodiment, the individual antennae are constructed as circuit boards using printed circuit techniques. This has the advantage that the individual antennae and the line transformer can be produced very economically and that they are accurately replicated.

In accordance with a further preferred embodiment of the antenna arrangement in accordance with the invention, more than two antennae are connected together in a tree-like structure. An optimal power output of the antennae is thereby achieved.

In accordance with a further preferred embodiment of the antenna arrangement in accordance with the invention, more than two antennae are connected together in a line. A very high power output is also achieved with this type of interconnection of the antennae. In addition, the simplified cable run in the automobile is of advantage.

BRIEF DESCRIPTION OF THE DRAWINGS

The invention will be explained hereinafter with the help of an advantageous embodiment which is illustrated in the attached drawing Figures wherein.

DETAILED DESCRIPTION OF THE PREFERRED EMBODIMENTS

Figure 1:
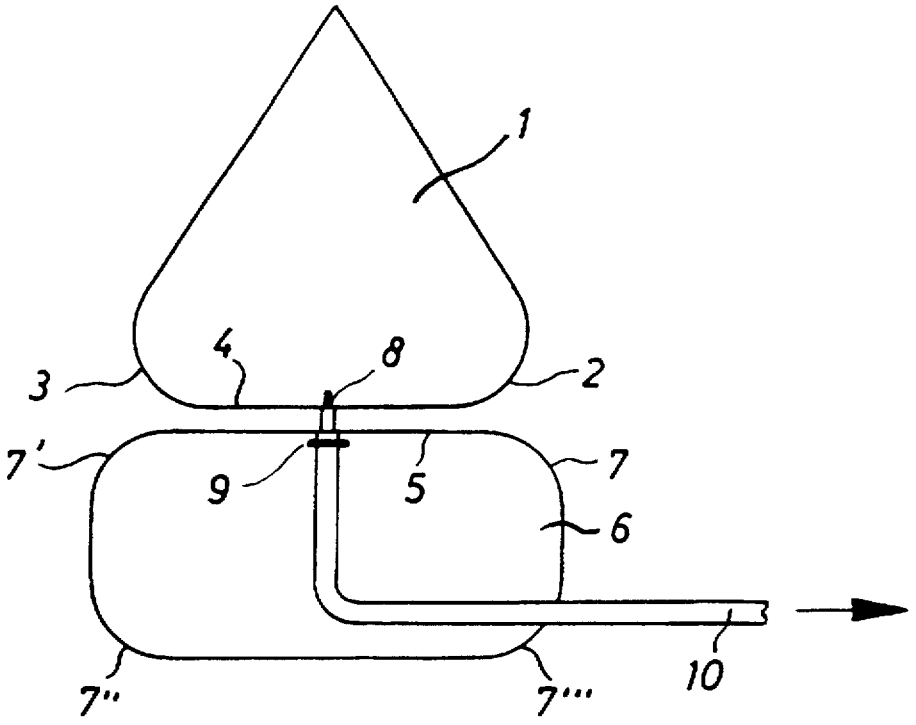
FIG. 1 shows a preferred embodiment of an antenna radiator in accordance with the invention, and FIG. 2 a preferred embodiment of the antenna arrangement in accordance with the invention.

FIG. 1 shows an antenna radiator 1 in accordance with the invention which takes the form of an equilateral triangle having rounded base corners 2 and 3. The base edge 4 of the radiator 1 is disposed parallel to the upper edge 5 of the electrical counterpoise 6. Basically, the electrical counterpoise 6 is constructed as a rectangle wherein its corners 7, 7', 7" and 7'" are rounded. Thereby, the long edge 5 of the electrical counterpoise 6 is made longer than the base edge 4 of the antenna radiator 1. The antenna radiator 1 and the electrical counterpoise 6 are connected, at mutually opposite feedpoints 8 and 9, to a feed line 10 which is constructed as a coaxial cable. The antenna radiator 1 and the electrical counterpoise 6 are built-up as metal foils which are welded between two films of synthetic material.

Figure 2:
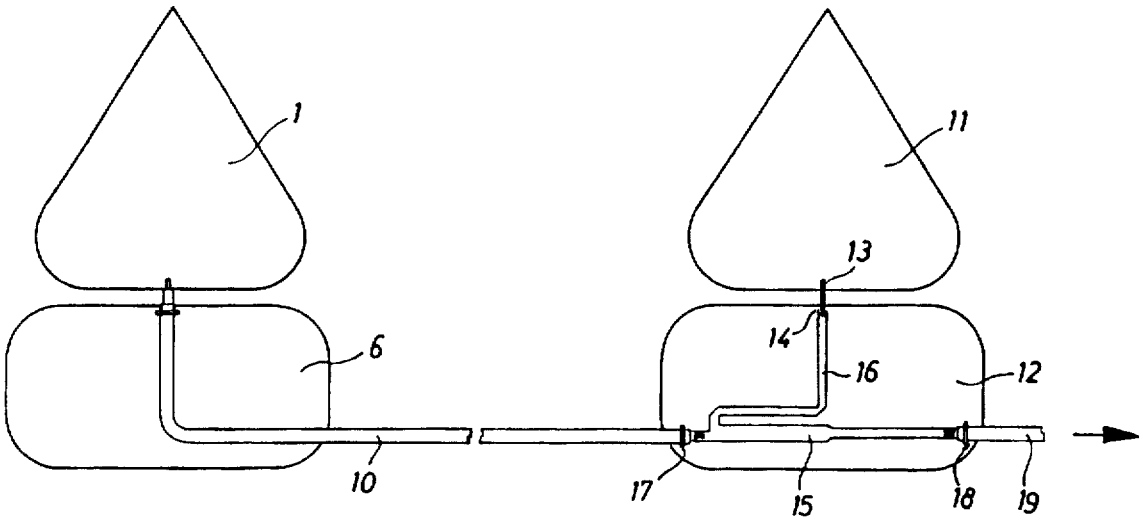

In the antenna arrangement in accordance with the invention which is illustrated in FIG. 2, a first monopole antenna consisting of an antenna radiator 1 and an electrical counterpoise 6 are electrically connected via a feed line 10 to a second monopole antenna consisting of an antenna radiator 11 and an electrical counterpoise 12. Thereby, the antenna radiator 11 and the electrical counterpoise 12 are electrically connected, at oppositely located feedpoints 13 and 14, to a strip line 16 which takes into account the characteristic impedance and which is mounted on the electrical counterpoise 12. A line transformer 15, which is constructed in the form of a strip line, is electrically connected via the contact point 17 to the feed line 10 and via the contact point 18 to the feed line 19. The line transformer 15 is likewise disposed on the electrical counterpoise 12 of the second monopole antenna.

We claim:

1. Antenna arrangement including:

at least two monopole antennas connected in parallel via a feed line, each of said antennas comprising an antenna radiator and an electrical counterpoise, said radiator and said counterpoise being connected, at mutually opposite feedpoints, to a respective conductor of said feed line; and a line transformer arranged on the respective counterpoise of at least one of said monopole antennas.

2. Antenna arrangement in accordance with claim 1, wherein said line transformer is constructed in the form of a strip line.

3. Antenna arrangement in accordance with claim 1 or 2, wherein said radiator has the shape of an equilateral triangle.

4. Antenna arrangement in accordance with claim 1 wherein the corners of said radiator and of said counterpoise are rounded.

5. Antenna arrangement in accordance with claim 1 wherein said monopole antennas are accommodated in at least one of the bumpers made of synthetic material of a motor vehicle.

6. Antenna arrangement in accordance with claim 5 wherein said monopole antennas are disposed on mutually opposite sides of said motor vehicle.

7. Antenna arrangement in accordance with claim 1 wherein said radiator has a length of substantially Lambda/4 in an operational frequency range.

8. Antenna arrangement in accordance with claim 7 wherein said operational frequency range lies in the electromagnetic decimetre-waveband.

9. Antenna arrangement in accordance with claim 1 wherein said monopole antennas are located at a distance of Lambda/4 from the bodywork of a motor vehicle in an operational frequency range.

10. Antenna arrangement in accordance with claim 1 wherein said monopole antennas are constructed as metal foils which are welded into films of synthetic material.

11. Antenna arrangement in accordance with claim 1 wherein said monopole antennas are constructed as circuit boards using printed circuit techniques.

12. Antenna arrangement in accordance with claim 1 wherein said monopole antennas are connected together as branches via said feed line in a tree-like structure.

13. Antenna arrangement in accordance with claim 1 wherein said monopole antennas are connected together via said feed line in a line.

14. The antenna arrangement defined in claim 1, wherein said antenna arrangement is disposed in a motor vehicle having a passenger compartment, said monopole antennas being disposed on portions of said motor vehicle such that radiation is reflected away from said passenger compartment.

15. An antenna arrangement, comprising:

at least two monopole antennas connected in parallel via a feed line, each of said antennas comprising an antenna radiator and an electrical counterpoise, said radiator and said counterpoise being connected, at mutually opposite feedpoints, to a respective conductor of said feed line, said monopole antennas providing a substantially circular azimuthal radiation pattern; and a line transformer arranged on the respective counterpoise of at least one of said monopole antennas.

* * * * *

UNITED STATES PATENT AND TRADEMARK OFFICE

CERTIFICATE OF CORRECTION

PATENT NO. : 5,793,337
DATED : August 11, 1998
INVENTOR(S) : Dieter Schenkyr, et al.

It is certified that error appears in the above-identified patent and that said Letters Patent is hereby corrected as shown below:

On the title page, add item;

--[63] Continuation of International Application Number PCT/EP94/01753, filed May 30, 1994, abandoned.--

Signed and Sealed this

Twenty-sixth Day of January, 1999

*Attest:*

*Attesting Officer*

*Acting Commissioner of Patents and Trademarks*